US011806578B2

(12) United States Patent
Rose

(10) Patent No.: US 11,806,578 B2
(45) Date of Patent: Nov. 7, 2023

(54) ROTATOR CUFF EXERCISE MACHINE

(71) Applicant: Greogry H. Rose, Littleton, CO (US)

(72) Inventor: Greogry H. Rose, Littleton, CO (US)

( * ) Notice: Subject to any disclaimer, the term of this patent is extended or adjusted under 35 U.S.C. 154(b) by 0 days.

(21) Appl. No.: 17/714,031

(22) Filed: Apr. 5, 2022

(65) Prior Publication Data

US 2023/0310932 A1 Oct. 5, 2023

(51) Int. Cl.
*A63B 23/12* (2006.01)
*A63B 21/00* (2006.01)
*A63B 21/062* (2006.01)

(52) U.S. Cl.
CPC ..... *A63B 23/1245* (2013.01); *A63B 21/0628* (2015.10); *A63B 21/4047* (2015.10); *A63B 2208/0233* (2013.01)

(58) Field of Classification Search
CPC ..... A63B 21/00072; A63B 21/00069; A63B 21/04; A63B 21/0421; A63B 21/0442; A63B 21/06; A63B 21/0615; A63B 21/0616; A63B 21/0617; A63B 21/062; A63B 21/0628; A63B 21/0632; A63B 21/078; A63B 21/08; A63B 21/154; A63B 21/155; A63B 21/156; A63B 21/22; A63B 21/40; A63B 21/4005; A63B 21/4007; A63B 21/4017; A63B 21/4019; A63B 21/4033; A63B 21/4035; A63B 23/1281; A63B 23/1245; A63B 23/1254; A63B 23/1263; A63B 23/1272
See application file for complete search history.

(56) References Cited

U.S. PATENT DOCUMENTS

| | | | | |
|---|---|---|---|---|
| 10,799,756 | B2 * | 10/2020 | Tuononen | A63B 21/0628 |
| 11,077,337 | B1 * | 8/2021 | Majkrzak | A63B 23/02 |
| 2007/0161470 | A1 * | 7/2007 | Berryman | A63B 69/3629 482/100 |
| 2007/0161472 | A1 * | 7/2007 | Drechsler | A63B 21/4017 482/99 |
| 2011/0034304 | A1 * | 2/2011 | Kuo | A63B 21/0628 482/99 |
| 2012/0277069 | A1 * | 11/2012 | Hockridge | A63B 21/159 482/139 |
| 2014/0057761 | A1 * | 2/2014 | Higgins | A63B 23/1209 482/94 |
| 2016/0279459 | A1 * | 9/2016 | Walker | A63B 21/4047 |
| 2022/0219036 | A1 * | 7/2022 | Anderson | A63B 23/035 |

* cited by examiner

*Primary Examiner* — Sundhara M Ganesan
*Assistant Examiner* — Zachary T Moore
(74) *Attorney, Agent, or Firm* — Gregory Perrone; Bobby W. Braxton; Braxton Perrone, PLLC

(57) ABSTRACT

Apparatus and method for providing a complete, one sided or simultaneously bilateral, rotator cuff weight resistance workout. The apparatus comprises user-selectable resistances from single or dual, graded, weight plate stacks with each plate increasing as the selected weight is increased. The four rotator cuff muscles are individually exercised by repositioning the arms of the apparatus.

10 Claims, 18 Drawing Sheets

ROTATOR CUFF EXERCISE MACHINE

FIELD OF THE DISCLOSURE

The claimed subject matter relates to an apparatus that allows focused exercise of the four shoulder rotator cuff muscles (supraspinatus, infraspinatus, subscapularis, and *teres* minor). The hip also contains rotator cuff muscles so for the sake of simplicity, this document will make reference to the shoulder rotator cuff muscles.

There is a vast spectrum of exercise machines and methods for strengthening the external muscles of the shoulder namely the deltoid, pectoralis, trapezius, serratus anterior, rhomboid, and latissimus dorsi, but very few machines and exercises that focus on the internal muscles of the shoulder, the rotator cuff. A few of these machine's exercise one or two of these muscles but none exist that exercise all four as do the novel SOLO and DUAL machines described here.

BACKGROUND

The shoulder joint is highly mobile due to the shallow cup design of the glenoid, but this mobility comes at the expense of instability. The hip joint, conversely, is highly stable due to the deep cup design of the acetabulum, but this stability comes at the expense of mobility.

The shoulder rotator cuff provides stability to the shoulder by anchoring the humeral head in the glenoid fossa with the supraspinatus, infraspinatus, subscapularis, and *teres* minor muscles.

Strength of the shoulder joint in athletics is crucial. The external muscles provide power and the internal muscles (rotator cuff) provide stability. Flexion and extension of the external muscles move the humerus in a plane while the internal muscles rotate the humerus about its long axis.

The functions of the rotator cuff muscles are as follows:

a. supraspinatus—abduction
b. infraspinatus—external rotation from as adducted shoulder
c. *teres* minor—adduction and external rotation from an abducted shoulder
d. subscapularis—adduction and internal rotation from an adducted shoulder.

Serious and casual athletes commonly neglect proper strengthening of the rotator cuff for several reasons: unawareness of its importance, unawareness of how to train the area, time consumption, boredom, no proper comprehensive equipment available, and not directly seeing the results.

Over time, adults lose about 10 percent of their total muscle mass each decade. This places a greater stress on the smaller rotator cuff muscles. With aging, there is an increasing incidence of rotator cuff tears usually from incidental, sudden pulling motions such as lifting a heavy suitcase, grabbing support while falling, or swinging the arm quickly and awkwardly. While some minor tears can improve with non-invasive rehabilitation, surgery may be required. This involves anesthesia, post-operative pain, medications, disability, loss of work/wages, extensive/expensive rehabilitation, limited use for 4-6 months, and potential complications such as retearing, chronic pain, and chronic weakness, among other things. Regardless of the reason, it is important for athletes and non-athletes to regularly strengthen their rotator cuffs. The presently described exercise machine provides effective exercise of all four rotator cuff muscles simply, safely, and efficiently.

Currently most rotator cuff exercises employ rubber exercise bands. The user usually attaches one side of the band to a doorknob or other fixed structure and pulls with the other. While this is a cheap and space saving solution, it is highly limited. The band increases in tension through the stroke of the cycle rather than delivering a constant force, and the force is not perpendicular to the circular path of the hand, the exercise is boring, and the weight is not easily adjustable.

Other machines have surfaced over the years, but none have provided exercises for all four rotator cuff muscles, adjustable weights, proper elbow stabilization, simultaneous bilateral exercise, and an incrementally increasing weight stack as does the presently described exercise machine.

BRIEF DESCRIPTIONS OF THE DRAWINGS

The novel features believed characteristic of the invention are set forth in the appended claims. The invention itself, however, as well as a preferred mode of use, further objectives, and advantages thereof, will be best understood by reference to the following detailed description of illustrative embodiments when read in conjunction with the accompanying drawings, wherein:

Figure 10:
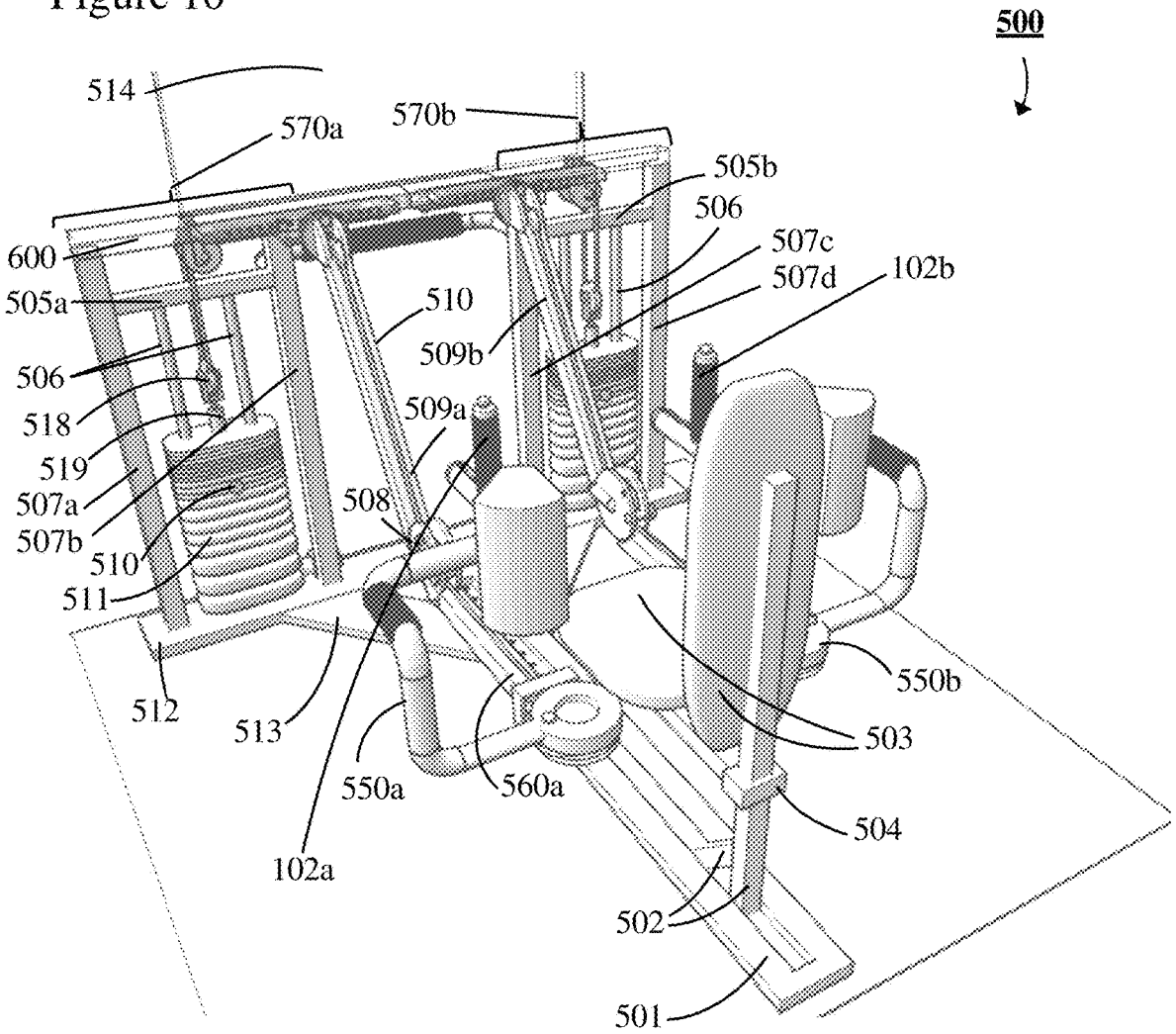

FIG. 10 a perspective view of a dual shoulder exercise apparatus according to the embodiments.

Figure 11:
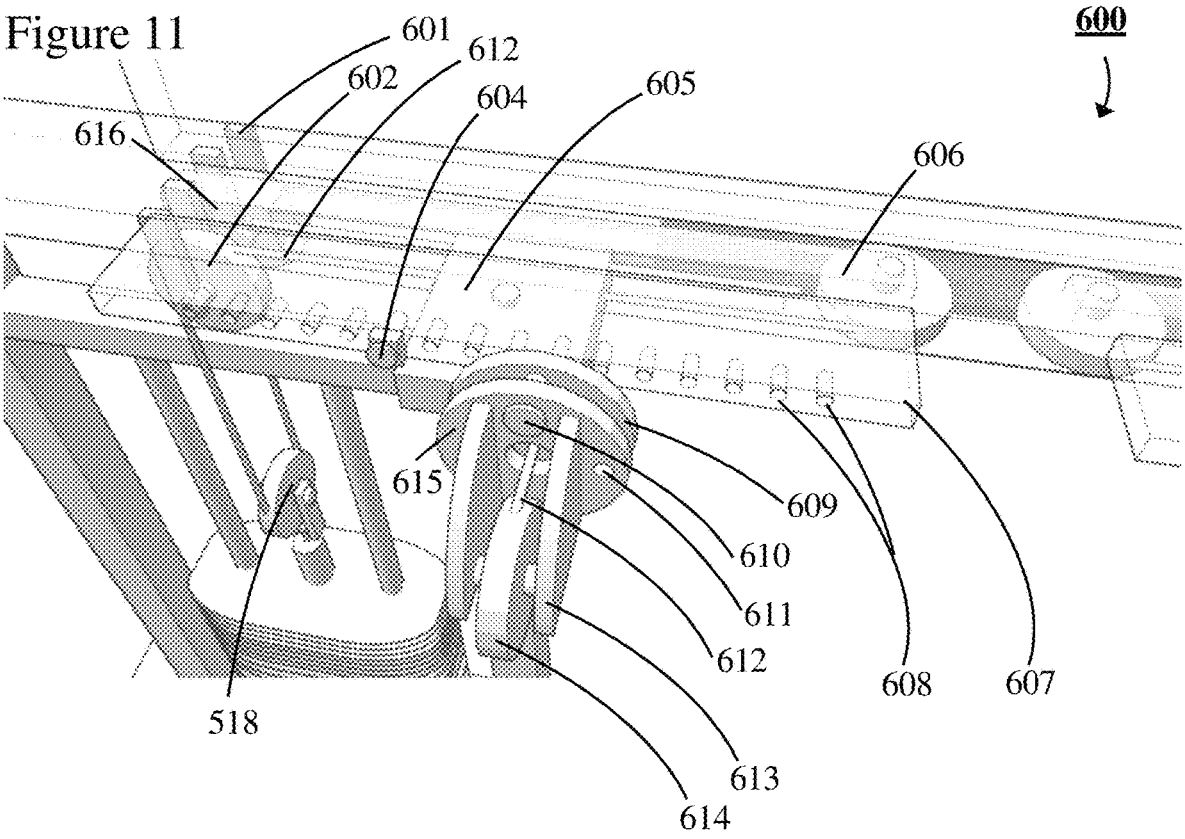

FIG. 11 is detailed view of a pulley rail and the arrangement of pulleys according to the embodiments.

Figure 12:
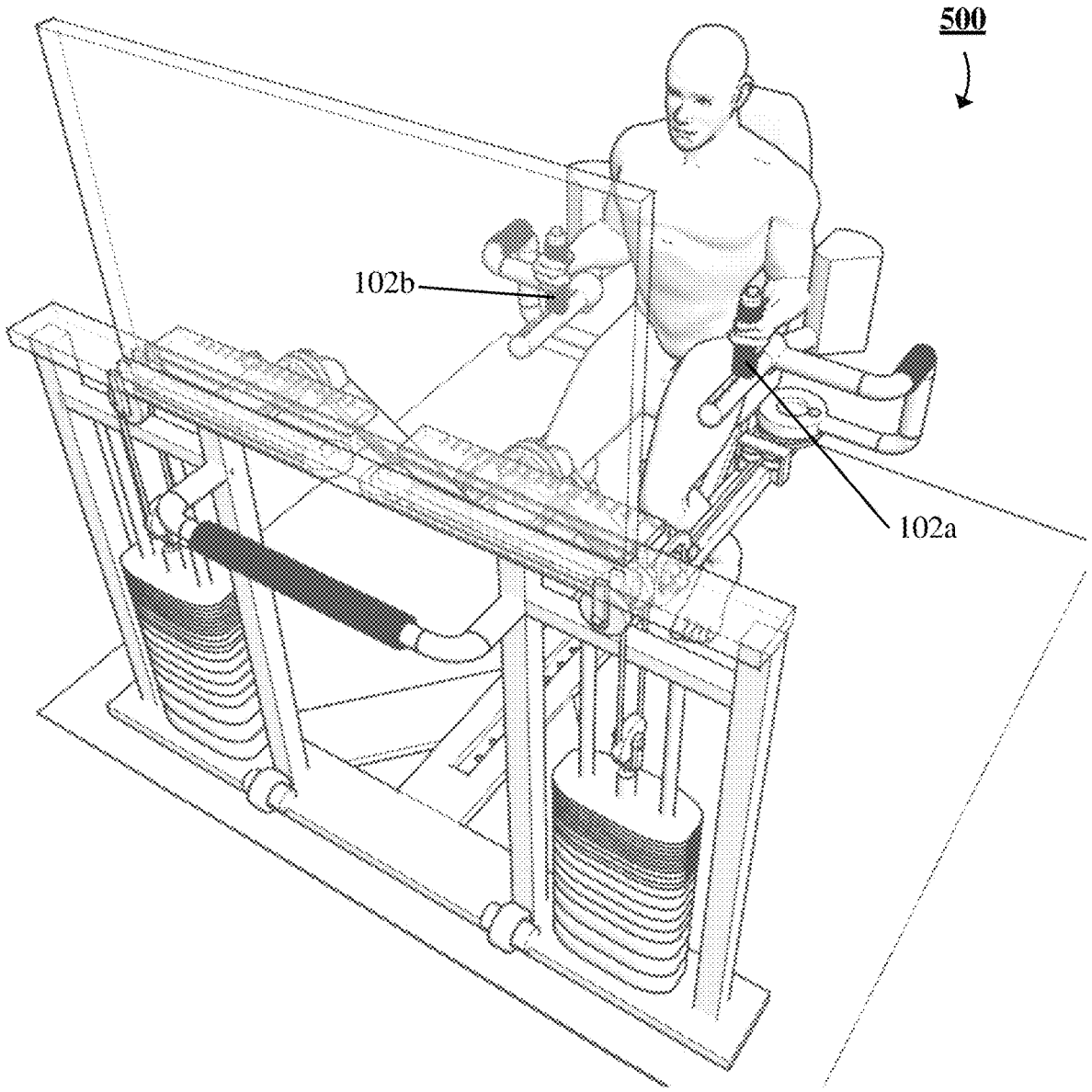

FIG. 12 depicts a user seated within dual shoulder exercise apparatus according to the embodiments.

Figure 13:
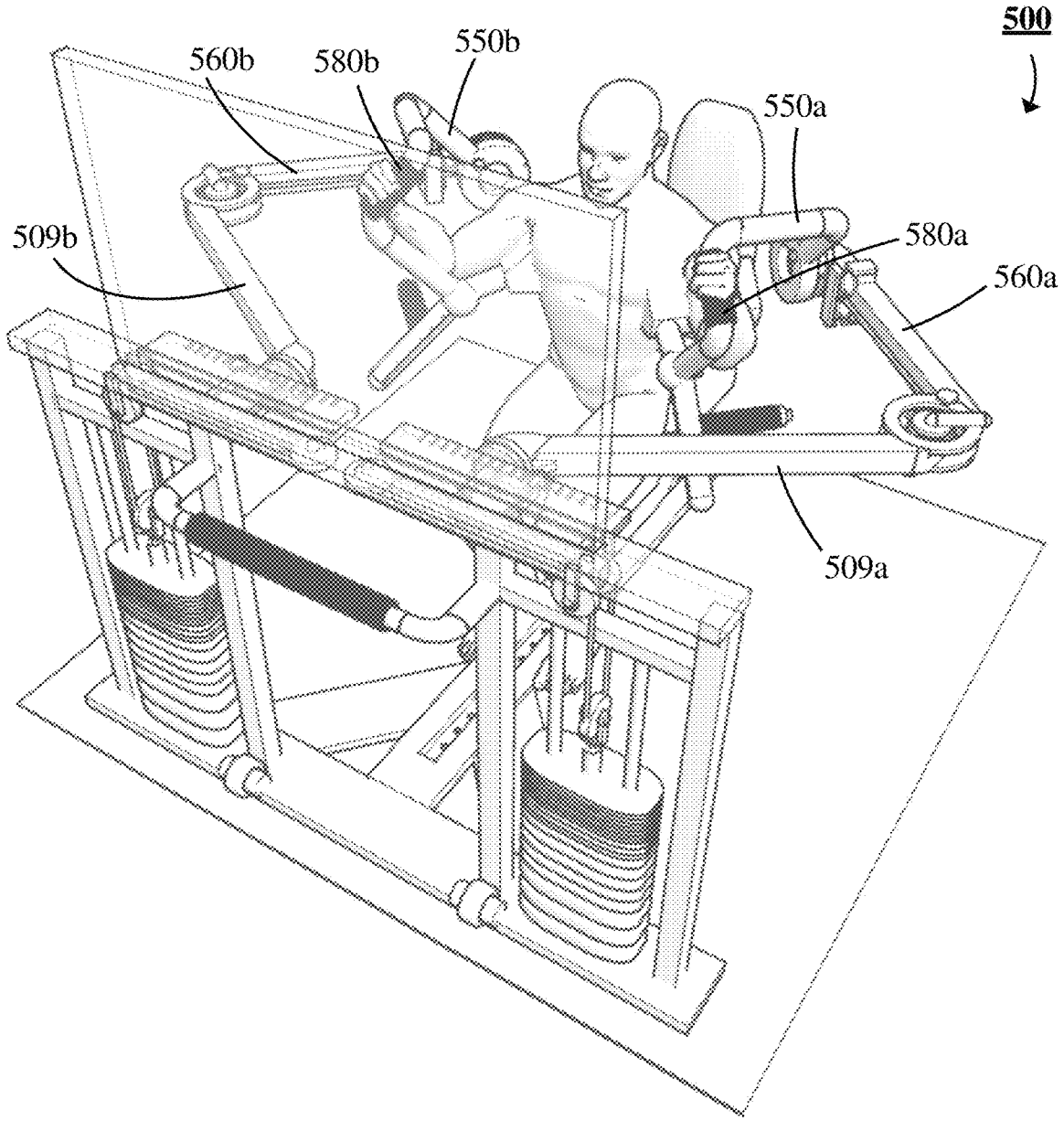

FIG. 13 depicts a user seated within dual shoulder exercise apparatus according to the embodiments.

Figure 14:
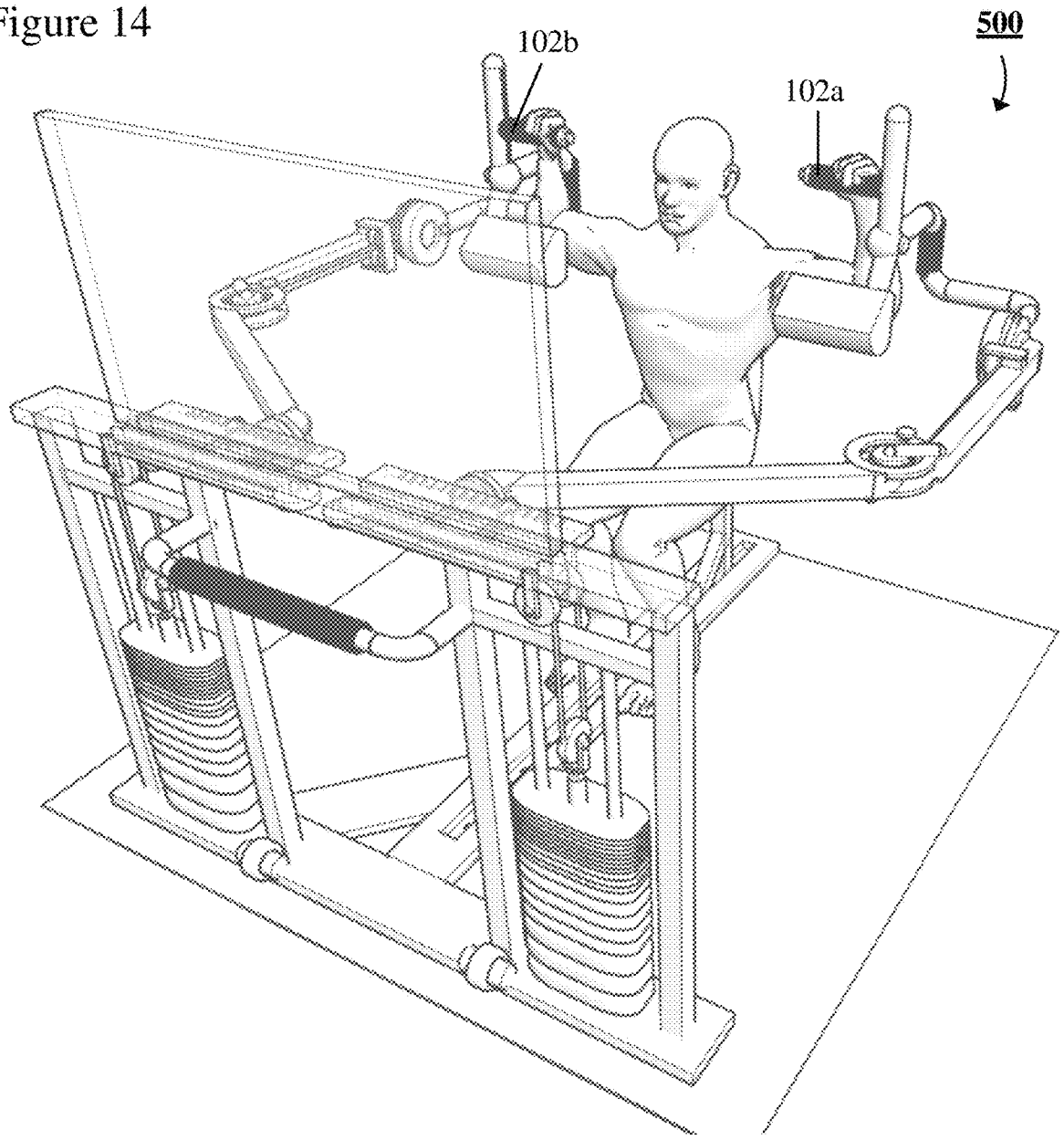

FIG. 14 depicts a user seated within dual shoulder exercise apparatus according to the embodiments.

Figure 15:
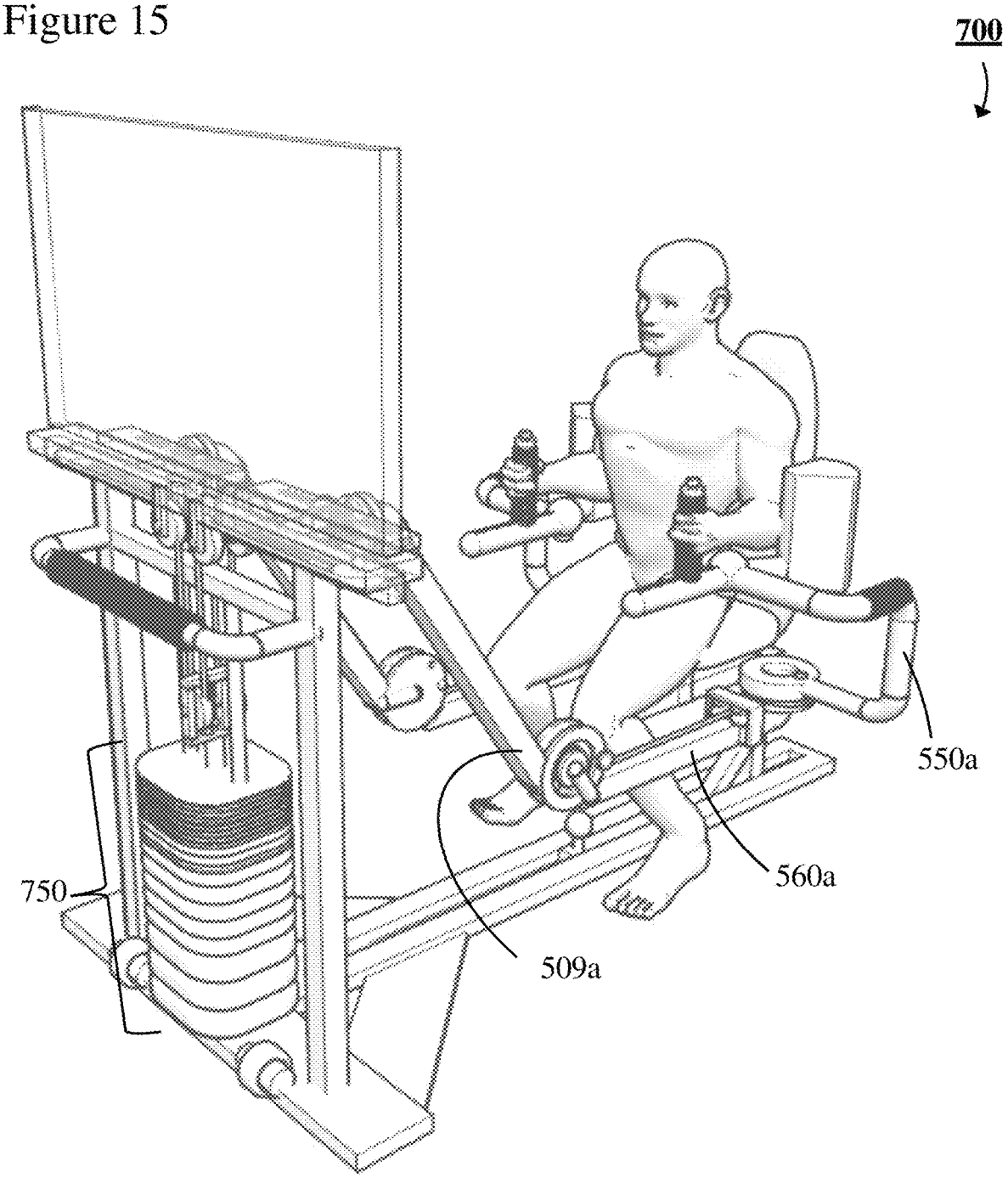

FIG. 15 depicts a variant of the dual shoulder exercise apparatus having a single weight assembly according to the embodiments.

Figure 16:
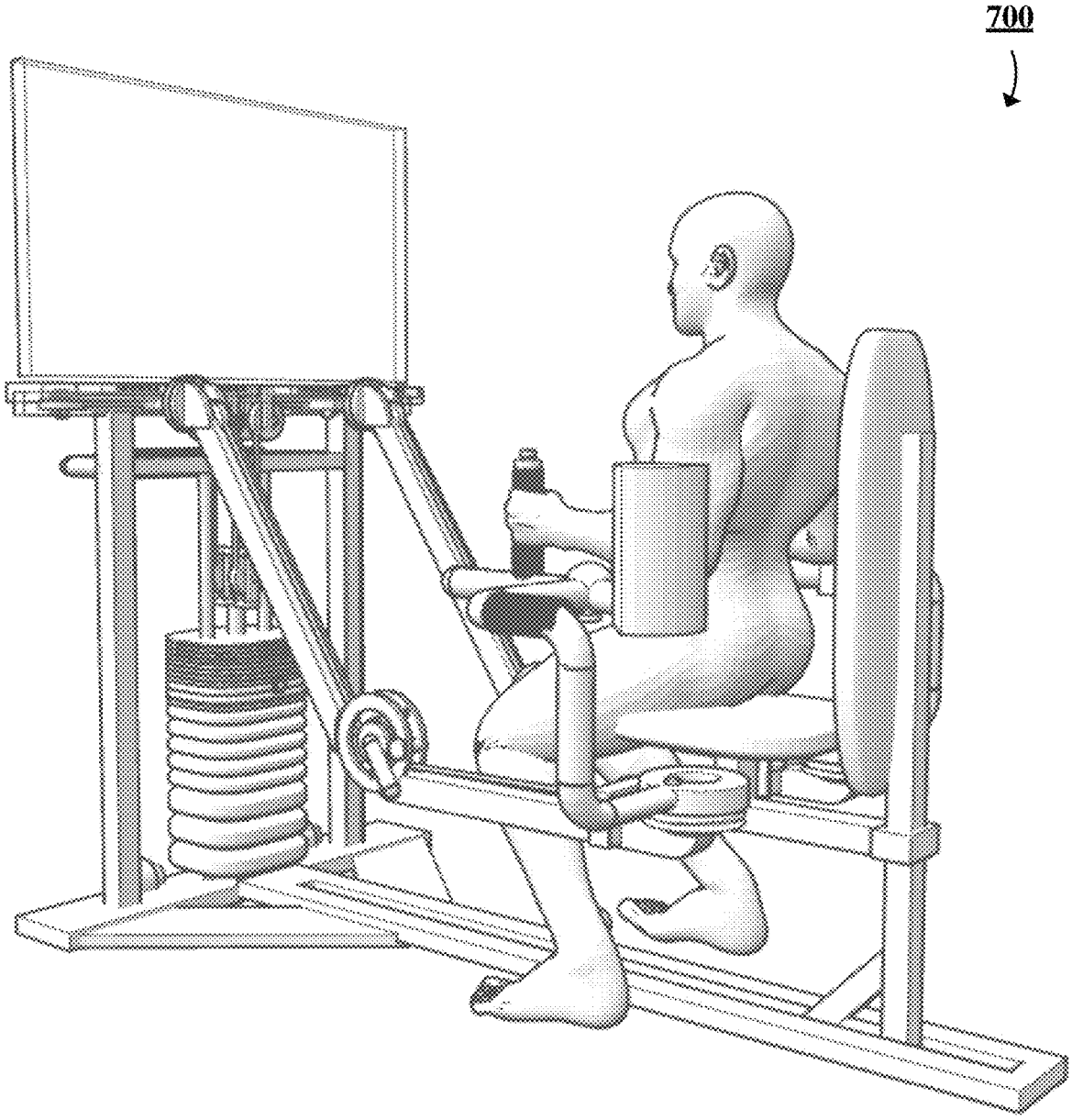

FIG. 16 depicts a variant of the dual shoulder exercise apparatus having a single weight assembly according to the embodiments.

Figure 17:
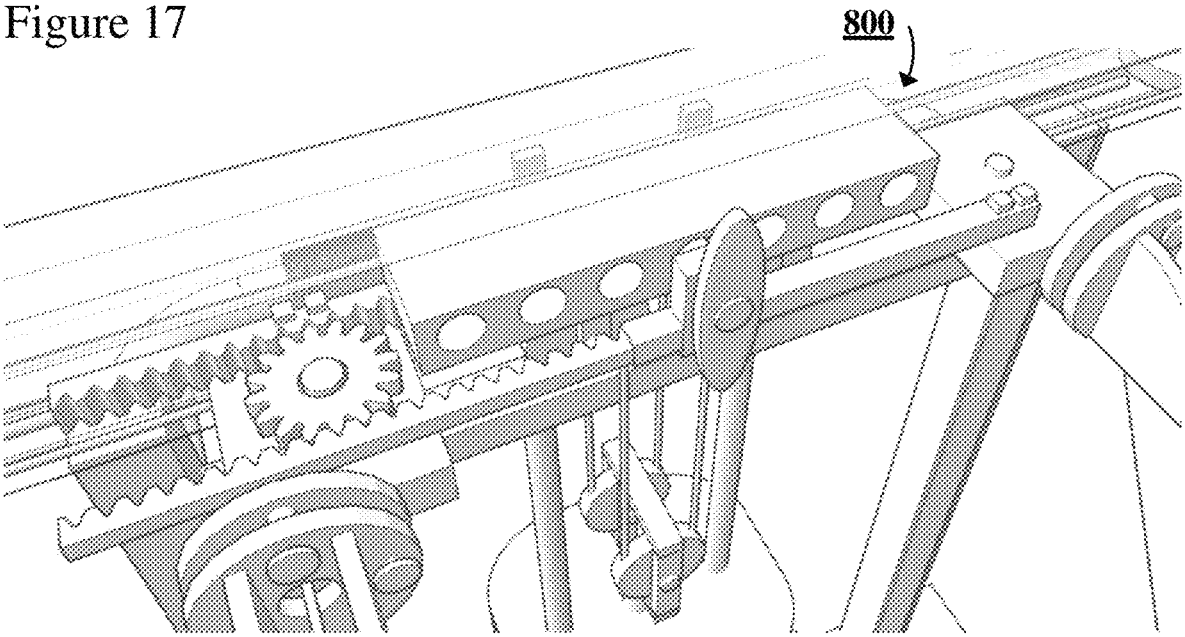

FIG. 17 is a perspective view of a pulley rail assembly according to the embodiments.

Figure 18:
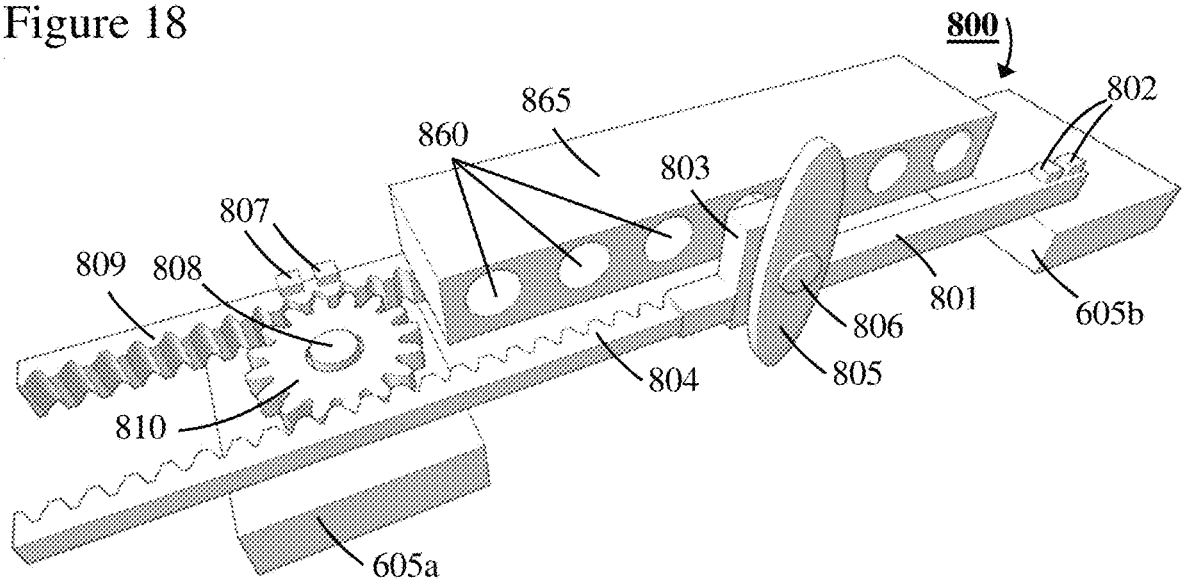

FIG. 18 is a perspective view of a pulley rail assembly according to the embodiments.

DETAILED DESCRIPTIONS OF THE DRAWINGS

Before undertaking the detailed description below, it may be advantageous to set forth definitions of certain words and phrases used in connection to the disclosed exemplary embodiments: the terms "include" and "comprise," as well as derivatives thereof, mean inclusion without limitation; the term "or" is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Although the subject matter of this application has been described with reference to illustrative embodiments, this description is not intended to be construed in a limiting sense. Various modifications and combinations of the illustrative embodiments as well as other embodiments will be apparent to persons skilled in the art upon reference to the description. It is, therefore, intended that the appended claims encompass any such modifications or embodiments. The general processes and systems described herein may be modified heavily depending on several factors, with rearrangement and/or addition/deletion of steps anticipated by the scope of the present disclosure. Integration of this and other preferred exemplary embodiment methods in conjunction with a variety of preferred exemplary embodiment systems described herein is anticipated by the overall scope of the presently disclosed system.

The presently described exercise machine will be broken down and referred to in two parts: One part is the SOLO rotator cuff machine, and another part is the DUAL rotator cuff machines. The SOLO machine exercises one rotator cuff side at a time. It is for those with limited space and budget. The DUAL machine exercises both rotator cuffs at the same time and incorporates an interactive video screen. DUAL is ideal for those with more space and a larger budget with interest in a user's onscreen virtual interaction.

1. Solo Rotator Cuff Machine

In the following detailed description, reference is made to accompanying drawings, and specific embodiments in which the invention may be used are shown by way of illustration. It is to be understood, however, that other embodiments may be utilized and that various changes may be made without departing from the spirit and scope of the present invention. The following description is, therefore, not to be taken in a limiting sense.

Figure 1:
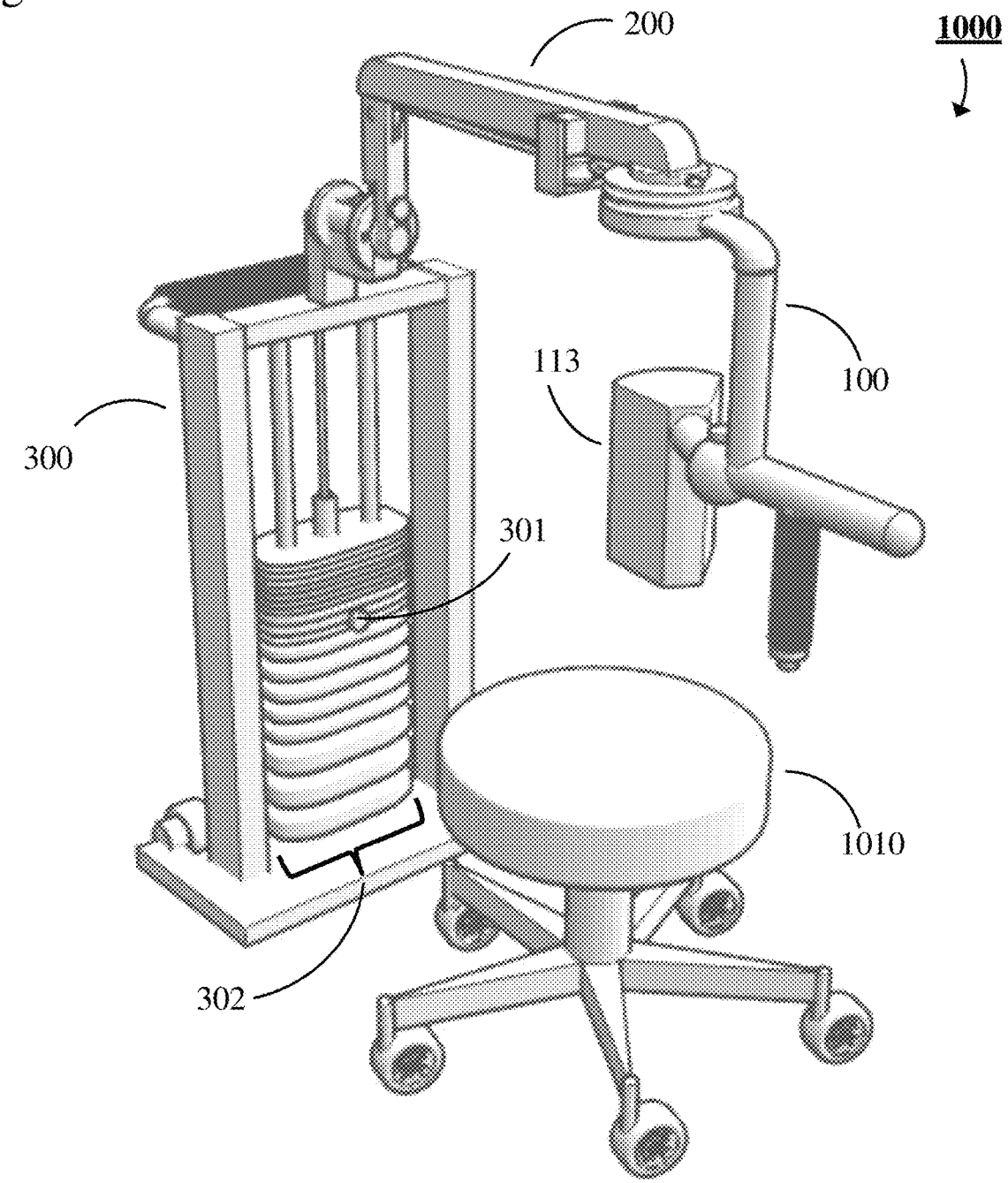
FIG. 1 is a perspective view of a single shoulder exercise apparatus according to the embodiments.

FIG. 1 a perspective view of a rotator cuff exercise apparatus according to an embodiment. In FIG. 1, single shoulder exercise apparatus 1000 is depicted. Single shoulder exercise apparatus 1000 is also referred to as a SOLO unit as a user may exercise one shoulder at a time on it. As shown in FIG. 1, in one embodiment single shoulder exercise apparatus 1000 comprises proximal rotating unit 100, connector bridge 200 and weight stack assembly 300. As shown in FIG. 1, single shoulder exercise apparatus 1000 is a small footprint machine designed to fit in a corner. The user sits on rolling seat 1010 that requires a brake. While elbow pad 113 counters motion and provides stability, as discussed below, the roller seat and therefore user would move without brakes. The user can easily change the amount of weight selected by repositioning the weight stack pin 301. Weight stack 302 comprises a series of graduated individual weight plates that include lighter, thinner plates towards the top of the stack and heavier, thicker plates as one approaches the lower end of weight stack 302.

Figure 2:
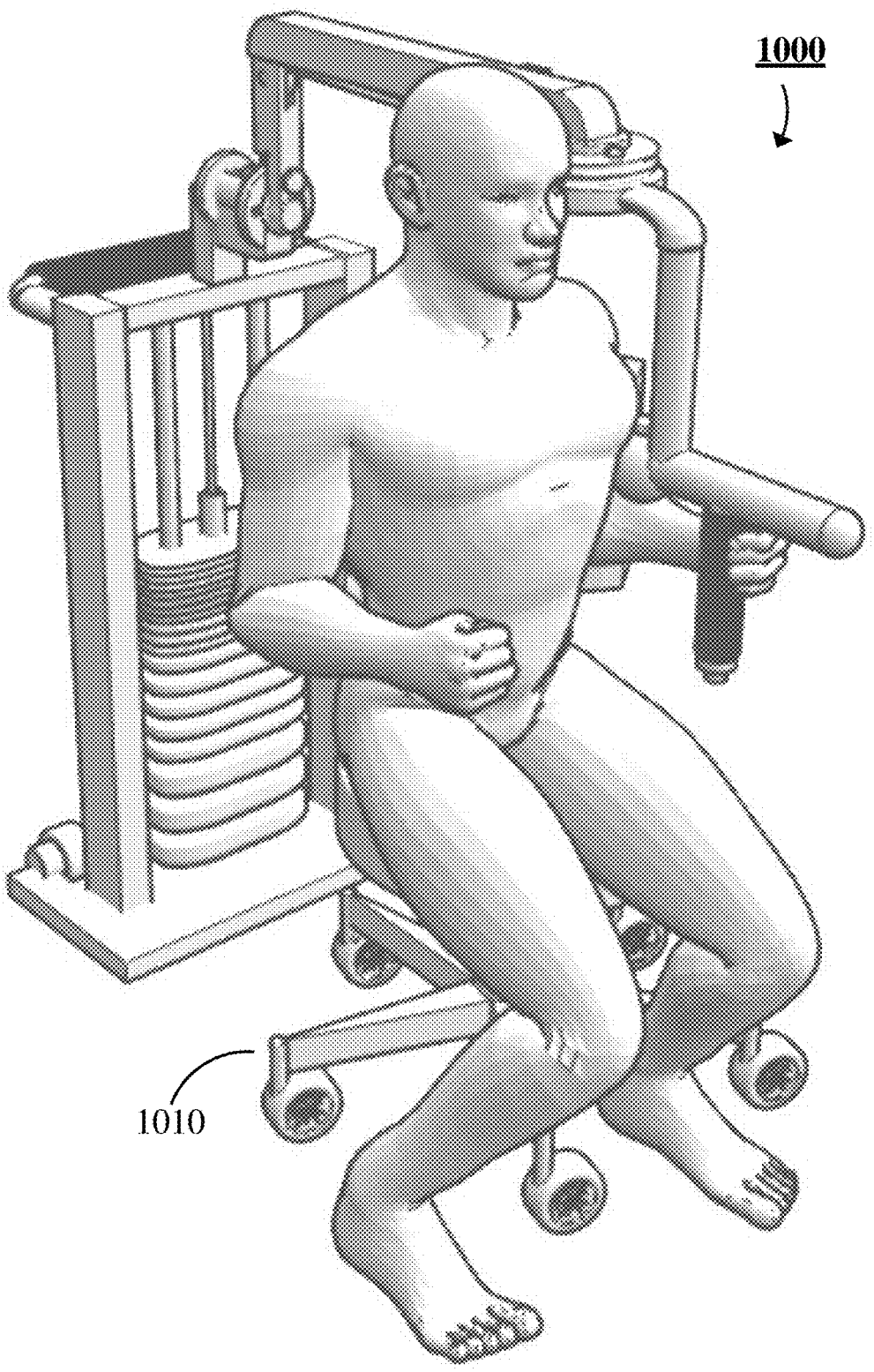
FIG. 2 is a perspective view of a single shoulder exercise apparatus with a user according to the embodiments.

FIG. 2 provides a perspective view of single shoulder exercise apparatus 1000 according to an embodiment with a user seated on rolling seat 1010 The user has the exerciser positioned for performing exercise of the infraspinatus and subscapularis muscles.

Figure 3:
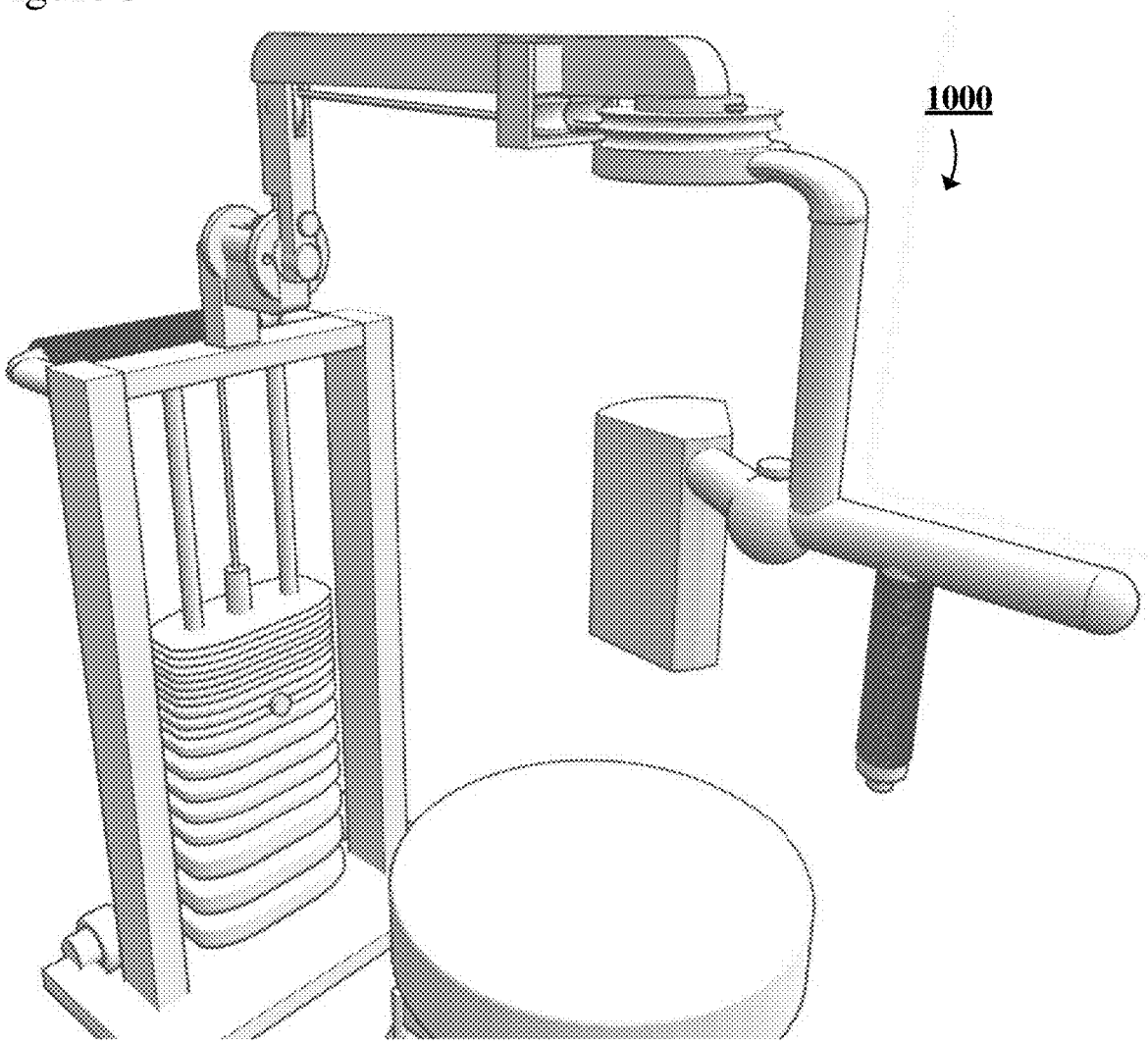
FIG. 3 is a magnified perspective view of a single shoulder exercise apparatus according to the embodiments.

FIG. 3 is a magnified perspective view of single shoulder exercise apparatus 1000 according to an embodiment.

Figure 4:
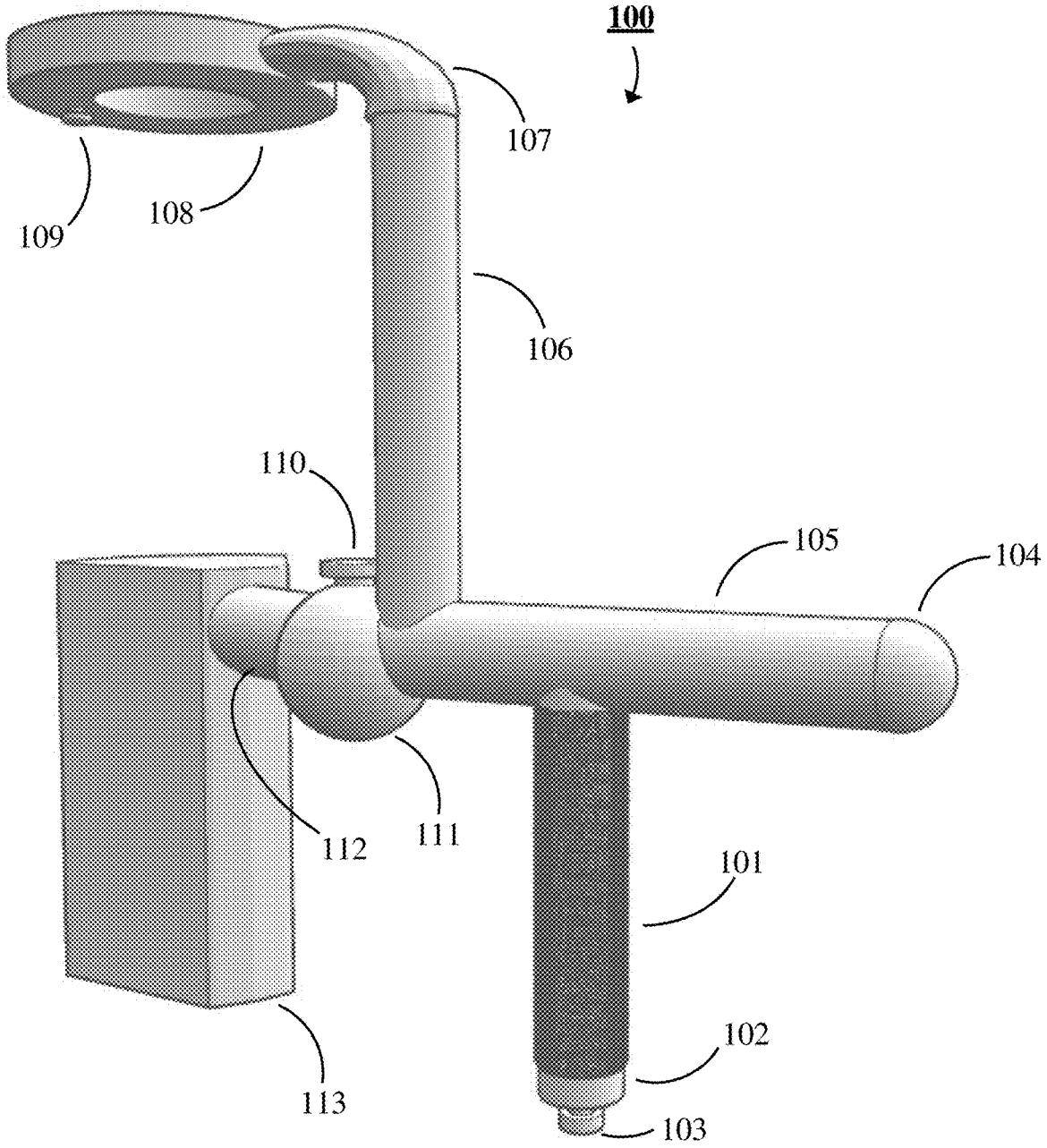
FIG. 4 is a perspective view of a proximal rotating unit of a single shoulder exercise apparatus according to an embodiment.
Figure 5:
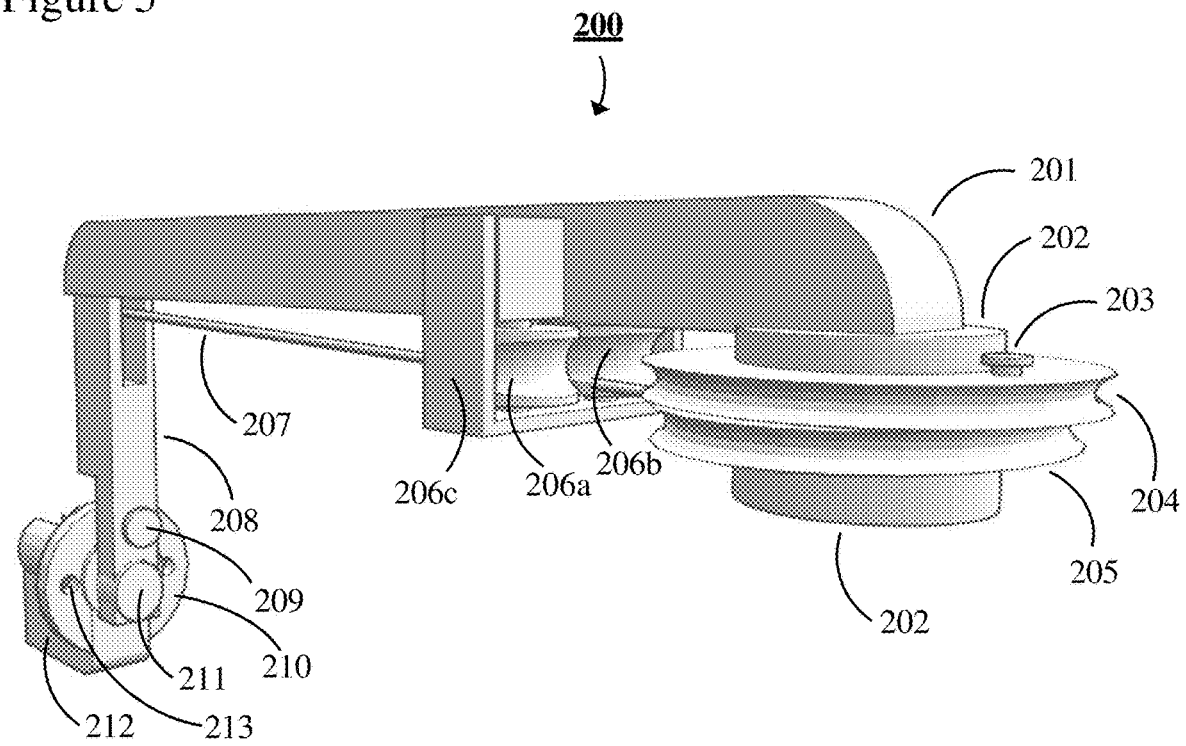
FIG. 5 is a perspective view of a connector bridge of a single shoulder exercise apparatus according to an embodiment.

FIG. 4 is a perspective view of the proximal rotating unit 100 of single shoulder exercise apparatus 1000 according to an embodiment. Proximal rotating unit 100 rotates about disk 108 (rotatably engaged with cylinder 202 as shown in FIG. 5) during the stroke cycle while the user exercises. Pin 109 allows setting of the start position of disk 108. Grip 101 in one embodiment is tubular and envelopes handle shaft 102 in order to provide the user more comfort and a better grip. Handle button 103 disposed at the underside of handle shaft 102 when depressed releases handle shaft 102 allowing handle shaft 102 it to be positioned at various locations along horizontal shaft 105 depending on the user's arm length. Soft cap 104 is disposed at the distal end of horizontal shaft 105 to protect the user from injury and prevent damage to the equipment, walls, etc. When single shoulder exercise apparatus 1000 is in use, the user's elbow rests against elbow pad 113. Shaft button 110 releases the pad shaft 112 so allow elbow pad 113 to flip to the opposite side articulating with ball joint 111. Rotating disk 108 articulates with the handle system through vertical pipe 106 and elbow pipe 107.

FIG. 5 is a diagram detailing connector bridge, 200 connecting the proximal rotating unit 100 to weight stack assembly 300. Disk 108 of proximal rotating unit 100 connects to cylinder 202. Cable 207 wraps around upper rotating disk 204 or lower rotating disk 205 depending on which disk is selected by the user via disk pin 203. In one embodiment, upper rotating disk 204 is circular and lower rotating disk 205 is elliptical. Upper rotating disk 204, which is round, allows constant force throughout the stroke by means of its constant radius, while lower rotating disk 205, which is elliptical, by means of its varying diameter initially delivers a smaller effective force than upper rotating disk 204, then midway through the stroke increases to a larger than upper rotating disk 204 force, then back down to a smaller effective force toward the end of the stroke. Housing 206 houses dual wheels **206*a* and 206*b* that force cable 207 to travel in a straight line and wrap more tightly around the upper rotating disk 204 or lower rotating disk 205. Fixed disk 210 allows selection of a 9, 12, or 3 o'clock position of the weight stack interface bar 208 depending on the exercise performed. Wheel pin 209 is used to select the position. Multiple holes 213 in wheel 210 are holes for receipt of wheel pin 209. Axle 211 enables rotation of weight stack interface bar 208. Weight stack interface 212 connects wheel 210 to weight stack assembly 300 via the stack wheel 309 of weight stack assembly 300**.

Figure 6:
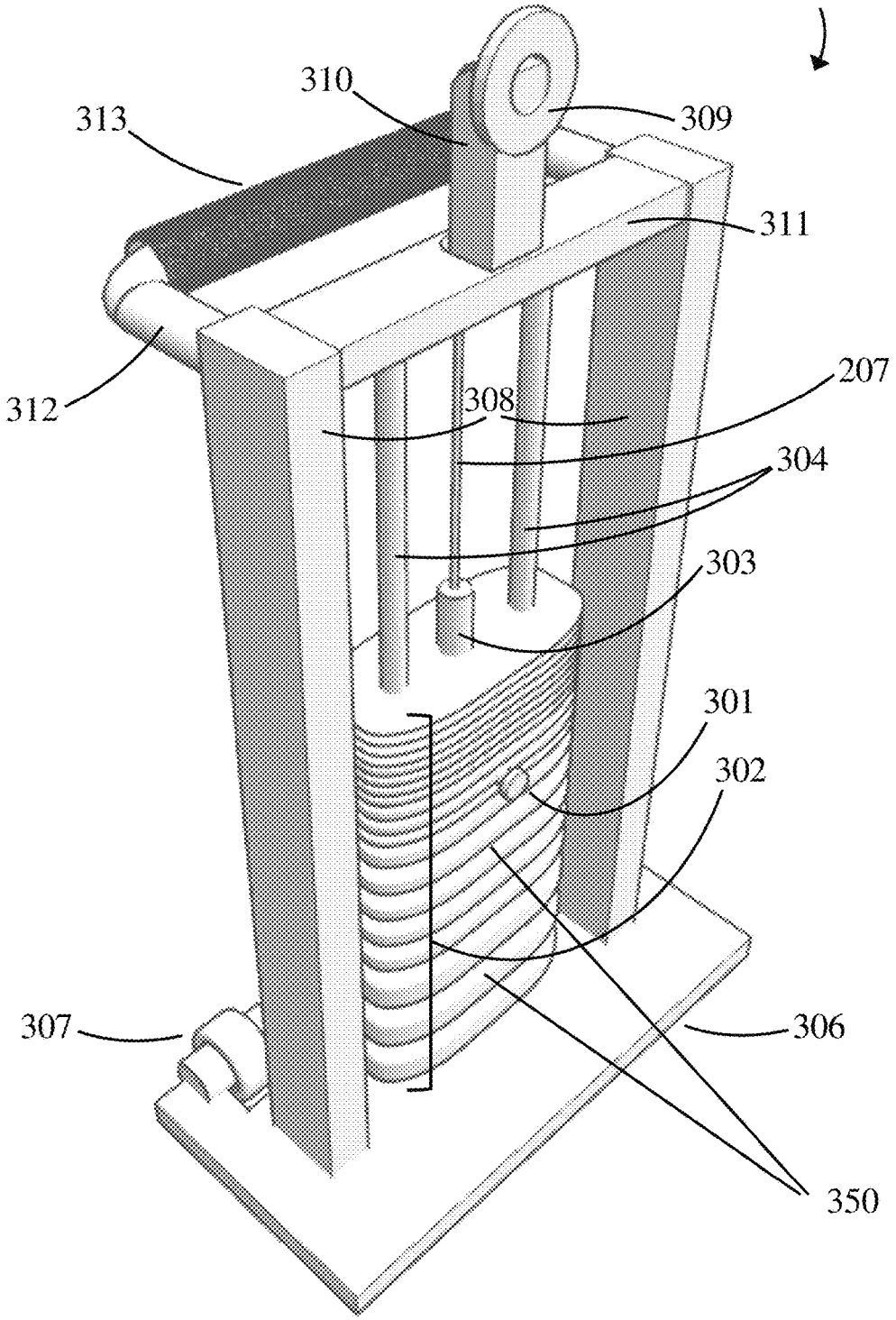
FIG. 6 is a perspective view of weight stack assembly of a single shoulder exercise apparatus according to an embodiment.

FIG. 6 is a perspective view of weight stack assembly 300. In one embodiment weight stack 302 is comprised of a plurality of weight plates 350, each of a different thickness, with thicker weight plates being heavier. In one embodiment, thinner and lighter weight plates are near and at the top of weight stack 302 and thicker and heavier weight plates are near and at the bottom of weight stack 302. The number of weight plates 350 in weight stack 302 that a user wishes to lift is selected by the placement of weight stack pin 301 into an aperture in one of the plurality of weight plates 350. In this manner, the weight plate in which weight stack pin 301 is inserted and the weight plates above it are the cumulative weights that the user will lift in the exercise. Weight plates 350 increase in weight downwards throughout the stack. Weight plates are stabilized by side rods 304 that pass through a pair or holes one each end of each weight plate 350 and pulled by center rod 303 through which weight stack pin 301 traverses. Thus, center rod 303 enables the lifting by virtue of placement of weight stack pin 301 in a weight plate that weight plate and the weight plates above it. Cable 207 attaches to 303 via the stack wheel 309. Base support 306, side supports 308, and top support 311 stabilize the structure. Bar 312 is a metal bar for tilting and rolling the apparatus for placement, with handle grip 313 disposed thereupon. Within base structure 306 are one or more base wheels 307 onto which weight stack assembly is tilted for transport. A symmetrically placed base wheel can be disposed on the other side of weight stack assembly.

Figure 7:
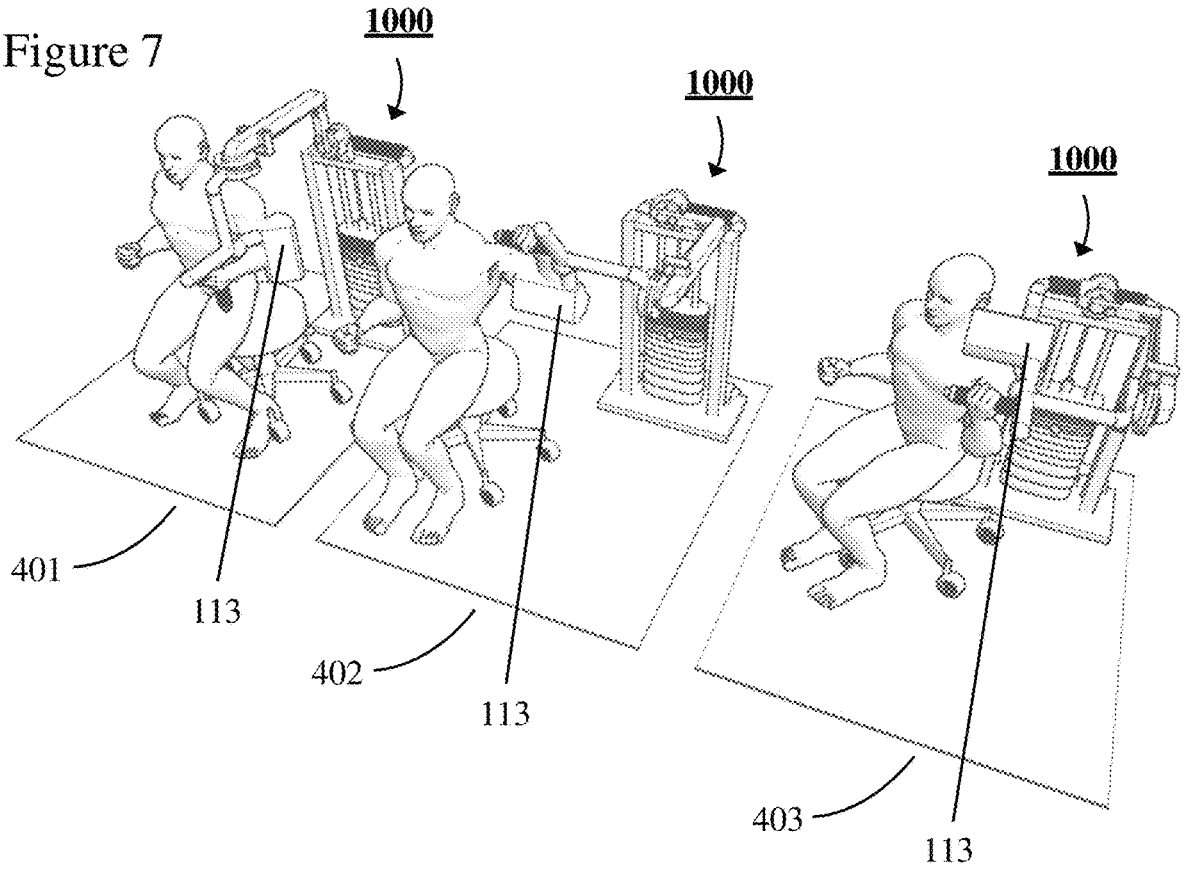
FIG. 7 is a perspective view of a multiple single shoulder exercise apparatus arrangement according to an embodiment.

FIG. 7 depicts three single shoulder exercise apparatus 1000 units arranged side by side in arrangements 401, 402 and 403. Each show a different user position to exercise the four rotator cuff muscles. The user exercises their left shoulder in each of the arrangements. In arrangement 401, two rotator cuff muscles are exercised. Externally rotating the apparatus exercises the infraspinatus muscle and internally rotating the apparatus exercises the subscapularis muscle. As the user internally rotates his shoulder, the triangular pad (113 in FIG. 1) offers counter pressure keeping the user from having to use additional muscles to stabilize the shoulder. With external rotation, the user's own lateral torso provides stabilization. Arrangement 402 shows the user posteriorly rotating the apparatus to exercise the *teres* minor muscle with pad 113 again providing support. Arrangement 403 shows the user superiorly rotating the apparatus to exercise the supraspinatus muscle with pad 113 again providing support.

2. Dual Rotator Cuff Machine

In the following brief description, reference is made to accompanying drawings, and specific embodiments in which the invention may be used are shown by way of illustration. It is to be understood, however, that other embodiments may be utilized and that various changes may be made without departing from the spirit and scope of the present invention. The following description is, therefore, not to be taken in a limiting sense.

Figure 8:
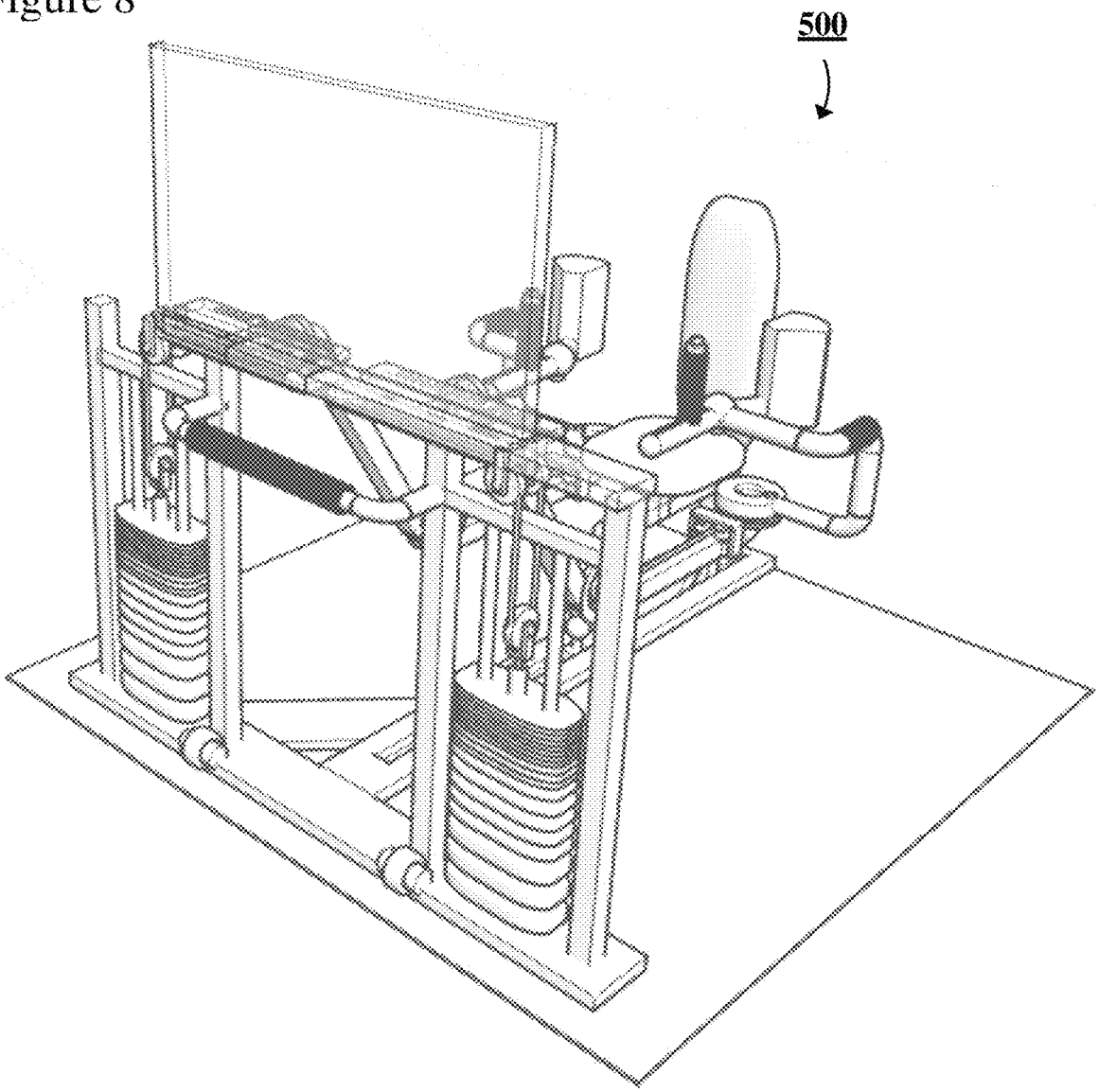
FIG. 8 is a perspective view of a dual shoulder exercise apparatus according to the embodiments.
Figure 9:
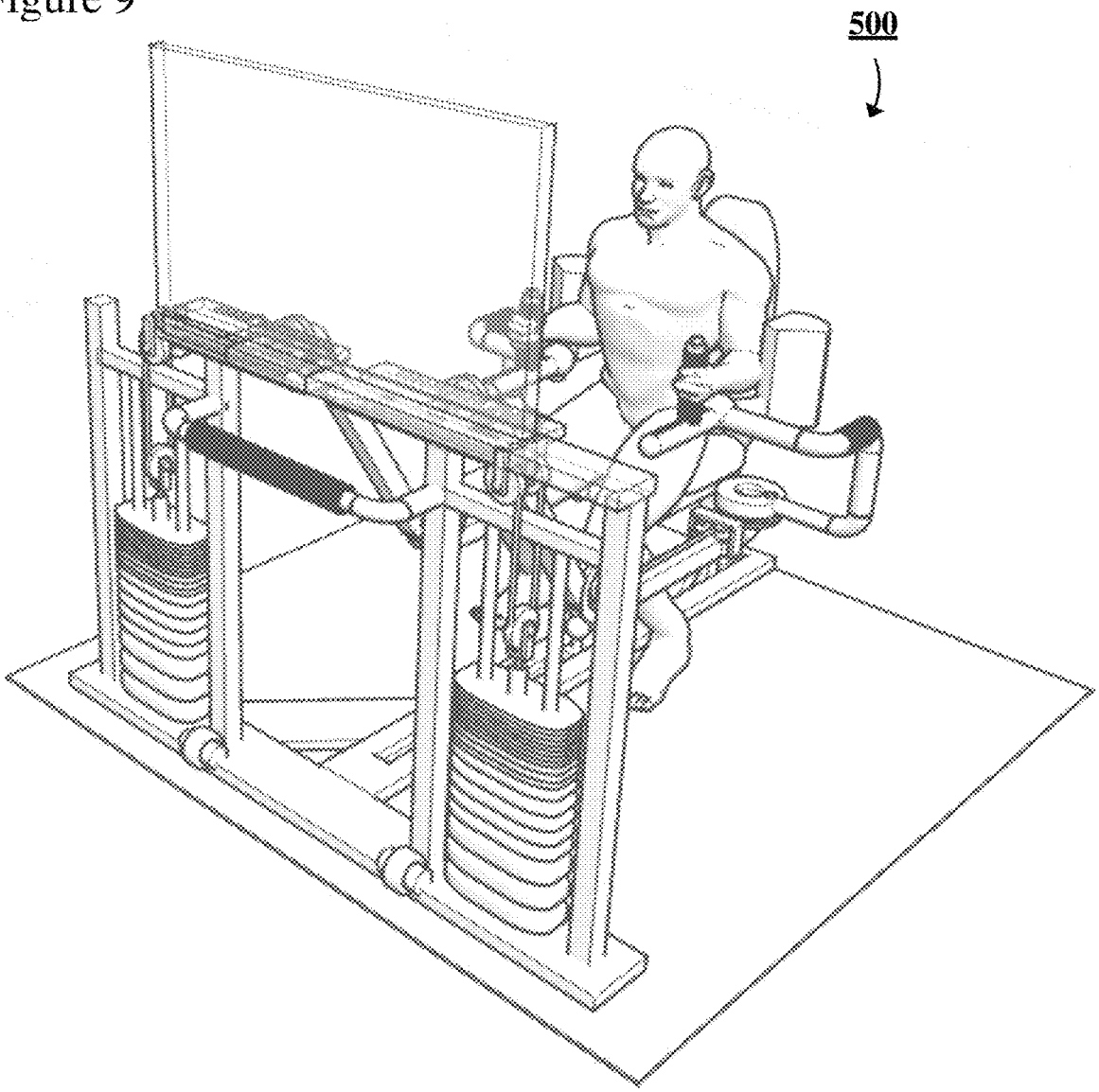
FIG. 9 is a perspective view of a dual shoulder exercise apparatus with a user seated in the apparatus according to the embodiments.

FIG. 8 is a is a perspective view of a dual shoulder exercise apparatus 500 according to the embodiments. FIG. 9 is a perspective view of a dual shoulder exercise apparatus 500 with a user seated in the apparatus according to the embodiments.

FIG. 10 is a perspective view of a dual shoulder exercise apparatus 500 according to the embodiments. In FIG. 5, many of the components of dual shoulder exercise apparatus 500, or the "dual" machine are the same as the single shoulder exercise apparatus 1000 previously described (or "solo" machine) and the two units operate in largely the same way with notable exceptions. Dual shoulder exercise apparatus 500 comprises first proximal rotating unit 550*a* and a second proximal rotating unit 550*b*, which are connected to first connector bridge 560*a* and second connector bridge 560*b* (shown in FIG. 13). First connector bridge 560*a* and second connector bridge 560*b* serve to connect first proximal rotating unit 550*a* and a second proximal rotating unit 550*b*, to left weight stack assembly 570*a* and right weight stack assembly 570*b*.

In operation of dual shoulder exercise apparatus 500 user sits in the seat facing forward, grasps the handles on each side and rotates each of first proximal rotating unit 550*a* and a second proximal rotating unit 550*b* unit in a direction commensurate with the orientation axis of rotating disk 508. This orientation is determined by the position of first connector bridge 560*a* and second connector bridge 560*b*, left armature 509*a* and right armature 509*b*, and the angulation of armatures 509*a* and 509*b* with respect to first connector bridge 560*a* and second connector bridge 560*b* through first armature pulley 508*a* and second armature pulley 508*b*, respectively. Seat 503 sits on support bracket 504 that adjusts up and down. The base, 502 slides forward and backward on slotted seat rail 501.

Left weight stack assembly 570*a* and right weight stack assembly 570*b* are similar in structure and operation as weigh stack assembly 300 in single shoulder exercise apparatus 1000 described in detail in FIG. 6. The pulley system associated with left weight stack assembly 570*a* and right weight stack assembly 570*b*, however, further allow adjustment of the separation of left armature 509*a* and right armature 509*b* depending on the user's shoulder separation. Left weight stack assembly 570*a* and right weight stack assembly 570*b*, consist of a stack of weight plates 511 on each assembly with the weight of each plate increasing as the stack continues downward, as in single shoulder exercise apparatus 1000 as described. Stabilizer pin 510 is inserted into an aperture of the desired weight plate 511 which selects the weight amount bilaterally. This allows the user to select a separate resistance for each shoulder e.g. if the user has a "normal" right shoulder but is rehabilitating the left shoulder. Center rod 519 is traversed with stabilizer pin 510 further inserted into a hole in center rod 519 to support the weight stack. Stabilizer bars 506 stabilize the weights as they move up and down. Pulley 518 lifts the selected weight plates 511 according to stabilizer pin 510 placement. Vertical stabilizer bars 507*a*, 507*b*, 507*c* and 507*d* provide stability and serve as a frame for weight stack assemblies 570*a* and 570*b*. Horizontal stabilizer bars 505*a* and 505*b* connect vertical stabilizer bars 507*a* and 507*b* and 507*c* and 507*d*, respectively. Base plate 512 spans across the bottom of dual shoulder exercise apparatus 500 and serve as the bottom of left weight stack assembly 570*a* and right weight stack assembly 570*b*. The bottom end of each of vertical stabilizer bars 507*a*, 507*b*, 507*c* and 507*d* are connected to base plate 512. A main pulley rail 600 spans across and above left weight stack assembly 570*a* and right weight stack assembly 570*b*. Positioned on the top side of main pulley rail 600, in one embodiment, is video monitor 514 that is connected electronically to dual shoulder exercise apparatus 500. Through monitor 514 the user is able to view a variety of displayed information such as repetitions, weight, exercise type, resting period, vital signs, scenery traveled through, game interface, virtual instructor, television programming movies, streaming entertainment, exercise dynamics (weights, repetitions, rest time, total exercise time, vitals), training, interactive games, and team competitions.

FIG. 11 is detailed view of main pulley rail 600 and the arrangement of pulleys to lift the weight stack and allow variable separation of the shoulders. In one embodiment, the pulley arrangement is housed within main pulley rail 600. As such, the several components are shown transparently for illustrative purposes. In other embodiments, however, some or all of the pulley components are located outside of the pulley rail or are exposed.

For purposes of describing the pulley system, left armature 509*a* is described, which works in association with left weight stack assembly 570A. However, main pulley rail 600 includes a dual arrangement so a second pulley arrangement as shown in FIG. 11 is provided in association with right armature 509*b* and right weight stack assembly 570*b*. For ease of illustration, however, the left pulley system is shown in FIG. 11. Left armature 509*a* is connected to center pulley 614 and pulley stabilizer 613. Center pulley 614 is associated with pulley stabilizer 613 via an axle that passes through a hole at the center of pulley 614. Pulley stabilizer is rotatably connected to rotating weight stack disk 615. Rotating disk 615 allows rotation among 12 or 3 o'clock positions depending on the exercise performed. First pulley pin 610 fixes this position via holes 611 placed in rotating weight stack disk 615. Back pulley disk 609 is a fixed disk stabilizing rotating disk 615. Cable 612 traverses back pulley disk 609 and rotating weight stack disk 615 to enter pulley box 605 that holds a pulley around which cable 612 bends to wrap around front left pulley 602 (shown transparently at left end of main pulley rail 600).

Cable 612 continues downward to wrap around pulley 518 of left weight stack assembly 570*a* (also shown in FIG. 10) and back up to left horizontal pulley 616, travelling horizontally to go around right horizontal pulley 606 and back into pulley box 605 to complete the cable travel. Main pully rail 600 comprises a series of pin holes 608 in block 607 that span across the rail. This allows pulley box 605 to be slidably positioned at a desired location along main pulley rail 600. By removing rail pin 604 and sliding pulley box 605 left or right, depositing rail pin 604 at the desired hole 608 in block 607, pulley box 605 is locked into place and the correct shoulder separation for the user is achieved.

FIG. 12 depicts a user seated within dual shoulder exercise apparatus 500 according to the embodiments positioned for exercising the infraspinatus and subscapularis muscles. Exercising the infraspinatus muscles is be achieved by externally rotating the handlebars 102*a* and 102*b* about the first and second proximal rotating units 550*a* and 550*b*, respectively. Exercising the subscapularis muscles is be achieved by internally rotating handlebars 102*a* and 102*b*.

FIG. 13 depicts a user seated within dual shoulder exercise apparatus 500 according to the embodiments, positioned for exercising the supraspinatus muscles. Exercising the supraspinatus muscles is be achieved by superiorly rotating upper handles 580*a* and 580*b* of first proximal rotating unit 550*a* and a second proximal rotating unit 550*b*. Note armatures 509*a* and 509*b* and connector bridges 560*a* and 560*b* are angled 45 degrees inward to position the handlebars correctly.

FIG. 14 depicts a user seated within dual shoulder exercise apparatus 500 according to the embodiments positioned for exercising the *teres* minor muscles. Exercising the *teres* minor muscles is be achieved by posteriorly rotating handlebars 102*a* and 102*b*.

FIG. 15 and FIG. 16 (oblique anterior and oblique posterior views, respectively) are diagrams illustrating another variant of the dual shoulder exercise apparatus 700 according to the embodiments positioned to allow simultaneous exercise of each side but with a single weight stack. In this embodiment, weight stack 750 is doubled in depth to match the total weight of the suppled via left weight stack assembly 570*a* and right weight stack assembly 570*b* and the weight plates 511 provided for dual shoulder exercise apparatus 500 (FIG. 10). This embodiment of dual shoulder exercise apparatus 700 would provide equal weight to each shoulder via first proximal rotating unit 550*a* and a second proximal rotating unit 550*b*, the associated connector bridges 560*a* and 560*b* and armatures 509*a* and 509*b*. While the larger "dual" machine of FIG. 10 with dual weight stacks allows for individual selection of resistance weight for each side, this thinner dual shoulder exercise apparatus 700 according to the embodiments is more lightweight as an overall unit due to elimination of parts serving as the various stabilizing components as previously described with reference to FIG. 10.

FIG. 17 and FIG. 18 depict an alternative embodiment of a main pulley rail described in FIG. 11. In this embodiment, main pulley rail 800 allows user selection of an appropriate shoulder separation distance.

In FIG. 18, main pulley rail 800 is shown separated from the main unit for clarity. Instead of separately selecting the shoulder separations with the rail pins 604, a single pin/handle 805 serves to place the separations with a rack and pinion assembly that moves pulley boxes 605*a* and 605*b* closer together or further apart. Shaft 801 is fixed to right pulley box 605 unit by struts 802. Shaft 801 is also attached to pin holder 803 and rack 804. Handle pin 806, attached to handle 805, pulls out and slides laterally to select shoulder separation. Handle pin 806 fits into one of seven holes 860 in block 865. Pinion 810 rotates about pinion axle 808 where pinion axle 808 is fixed in position from above. Rear rack 809 is attached to left pulley box 605*a* by struts 807. When handle 805 is pulled out and moved to the right, right pulley box 605*b* moves to the right. Simultaneously, rack 804 causes pinion 810 to rotate counterclockwise moving rack 809 to the left and therefore moving left pulley box 605*a* to the left the same distance as the handle 805 was moved to the right. The same principle applies when the handle is moved to the left causing pulley boxes 605*a* and 605*b* to move together.

The above summary is not intended as an exhaustive description of the claimed subject matter but, rather, is intended to provide a brief overview of some of the functionality associated therewith. Other systems, methods, functionality, features and advantages of the claimed subject matter will be or will become apparent to one with skill in the art upon examination of the following figures and detailed description. Although various embodiments of the present disclosure have been illustrated in the accompanying drawings and described in the foregoing Detailed Description, it will be understood that the present system is not limited to the embodiments disclosed, but is capable of numerous rearrangements, modifications, and substitutions without departing from the spirit of the system as set forth and defined herein.

I claim:

1. A mechanic exercise apparatus, configured to provide resistance exercises to four rotator cuff muscles, comprising:

at least one proximately rotating arm having a handle disposed perpendicularly to a main shaft and a vertical shaft arranged perpendicularly to an end of the main shaft;

a first disk rotatably engaged to a cylindrical axle passing through a round rotating disk and an elliptical rotating disk, for rotational movement of the rotating arm;

a ball joint joining the main shaft to a pad, the ball joint configured to allow rotation of the proximately rotating arm by a user;

a bridge comprising the cylindrical axle at a distal end of the bridge and a weight stack disk on a proximate end of the bridge connecting the at least one proximately rotating arm to a weigh stack; and the weight stack comprising a plurality of vertically arranged weight plates, each of the plurality of weight plates having a thickness less than a weight plate below itself within the vertical arrangement, wherein the weight is rotatably engaged with the weight stack assembly to flip the proximately rotating arm and bridge from a user's right side to a user's left side.

2. A mechanical exercise apparatus, configured to provide resistance exercises to four rotator cuff muscles, comprising:

two proximately rotating arms each having a handle disposed perpendicularly to a respective main shaft and a respective vertical shaft arranged perpendicularly to an end of the respective main shaft;

two bridges, each bridge of the two bridges associated with a respective proximately rotating arm of the two proximately rotating arms, each bridge comprising a cylindrical axle at a distal end of the respective bridge and at least one weight stack on a proximate end of the respective bridge connecting the respective proximately rotating arms to at least one weigh stack;

two first disks, each first disk rotatably engaged to one respective cylindrical axle of the two cylindrical axles, the two cylindrical axles each passing through a respective round rotating disk and a respective elliptical rotating disk, for rotational movement of the respective proximately rotating arm;

a ball joint disposed on each of the two proximately rotating arms, each ball joint joining the respective main shaft and a respective pad, the ball joints configured to allow rotation of the respective proximately rotating arm by a user; and the least one weight stack comprising a plurality of vertically arranged weight plates, each of the plurality of weight plates having a thickness less than a weight plate below it within the vertical arrangement, wherein each weight stack disk is rotatably engaged with the at least one weight stack such that the respective proximately rotating arms and bridges are rotatable relative to the at least one weight stack.

3. The mechanical exercise apparatus of claim 2, further comprising a main pulley rail comprising a plurality of location apertures and a location selection pin connecting one of the two proximately rotating arms and one of the two bridges to an other of the two proximately rotating arms and an other of the two bridges.

4. The mechanical exercise apparatus of claim 3, further comprising a first pulley assembly housed within the main pulley rail and a second pulley assembly housed within the main pulley rail.

5. The mechanical exercise apparatus of claim 4, wherein the first pulley assembly comprises a first pair of horizontally pulleys and a first vertical pulley; and the second pulley assembly comprises a second pair of horizontally pulleys and a second vertical pulley.

6. The mechanical exercise apparatus of claim 5, wherein the location selection pin is insertable into any of the plurality of location apertures to designate a pre-selected distance between each of the two bridges and two proximately rotating arms.

7. The mechanical exercise apparatus of claim 6, further comprising a first pulley box associated with the first pulley assembly, slidably engaged with the mail pulley rail for adjusting a position of the respective weight stack disk disposed on the end of the one bridge of the two bridges.

8. The mechanical exercise apparatus of claim 7, further comprising a second pulley box associated with the second pulley assembly, slidably engaged with the mail pulley rail for adjusting a position of the respective weight stack disk disposed on the end of the other bridge of the two bridges.

9. The mechanical exercise apparatus of claim 2, further comprising a video display disposed on a main pulley rail.

10. The mechanical exercise apparatus of claim 9, wherein the video display displays information comprising television programs, movies, streaming entertainment, exercise dynamics, including: weights, repetitions, rest time, total exercise time, vitals), training, interactive games, and team competitions.

* * * * *